US011749149B2

(12) United States Patent
Huang et al.

(10) Patent No.: US 11,749,149 B2
(45) Date of Patent: Sep. 5, 2023

(54) METHOD AND DEVICE FOR DETECTING RESIDUAL IMAGE OF A DISPLAY PANEL

(71) Applicant: KunShan Go-Visionox Opto-Electronics Co., Ltd, Jiangsu (CN)

(72) Inventors: Zhijuan Huang, Kunshan (CN); Zhixiang Wang, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 17/715,531

(22) Filed: Apr. 7, 2022

(65) Prior Publication Data

US 2022/0230568 A1 Jul. 21, 2022

Related U.S. Application Data

(63) Continuation of application No. PCT/CN2021/077888, filed on Feb. 25, 2021.

(30) Foreign Application Priority Data

Apr. 9, 2020 (CN) ..... 202010276323.9

(51) Int. Cl.
*G09G 3/00* (2006.01)
*G09G 3/20* (2006.01)

(52) U.S. Cl.
CPC ..... *G09G 3/006* (2013.01); *G09G 3/2003* (2013.01); *G09G 2320/0257* (2013.01)

(58) Field of Classification Search
None
See application file for complete search history.

(56) References Cited

U.S. PATENT DOCUMENTS

2002/0067325 A1 6/2002 Choi
2009/0096778 A1 4/2009 Su et al.
(Continued)

FOREIGN PATENT DOCUMENTS

CN 1779473 A 5/2006
CN 101425246 A 5/2009
(Continued)

OTHER PUBLICATIONS

International Search Report (with English Translation) and Written Opinion dated May 20, 2021, in corresponding International Application No. PCT/CN2021/077888, 13 pages.
(Continued)

*Primary Examiner* — Andre L Matthews
(74) *Attorney, Agent, or Firm* — Maier & Maier, PLLC

(57) ABSTRACT

This application discloses a method for detecting residual image of a display panel, including: controlling a display panel to display a checkerboard image including pure-color sub-images, gray scales of two adjacent pure-color sub-images are a first gray scale and a second gray scale; controlling, after the checkerboard image has been displayed for a first time period, the display panel to display a detection image with a predetermined gray scale; controlling a reference display panel to display a calibration image including first and second matrix images, a gray scale of each first matrix image is the same as the predetermined gray scale, gray scales of each second matrix image includes a third gray scale being the same as the predetermined gray scale and a fourth gray scale different from the predetermined gray scale; comparing the detection image and the calibration image to obtain a residual image level of the display panel.

12 Claims, 7 Drawing Sheets

(56) References Cited

U.S. PATENT DOCUMENTS

| | | | | |
|---|---|---|---|---|
| 2010/0033205 | A1* | 2/2010 | Zhao | G02F 1/1309 324/760.01 |
| 2015/0062203 | A1* | 3/2015 | Sun | G09G 3/2044 345/694 |
| 2015/0371576 | A1* | 12/2015 | Li | G09G 3/006 345/87 |
| 2016/0035277 | A1* | 2/2016 | Han | G09G 3/3233 345/80 |
| 2016/0365025 | A1* | 12/2016 | Ding | G09G 3/006 |
| 2017/0214911 | A1* | 7/2017 | Wang | G06T 7/0004 |
| 2020/0143737 | A1* | 5/2020 | Wei | G09G 3/3208 |
| 2020/0160801 | A1* | 5/2020 | Wang | H04N 1/4078 |

FOREIGN PATENT DOCUMENTS

| | | | |
|---|---|---|---|
| CN | 101996591 | A | 3/2011 |
| CN | 103050074 | A | 4/2013 |
| CN | 104282251 | A | 1/2015 |
| CN | 107256686 | A | 10/2017 |
| CN | 108877615 | A | 11/2018 |
| CN | 108922463 | A | 11/2018 |
| CN | 109345986 | A | 2/2019 |
| CN | 110033726 | A | 7/2019 |
| CN | 106297613 | B | 8/2019 |
| CN | 110376218 | A | 10/2019 |
| CN | 111341233 | A | 6/2020 |

OTHER PUBLICATIONS

Notification to Grant Patent Right for Invention dated Feb. 28, 2022, in corresponding to Chinese Application No. 202010276323.9, 7 pages (with English Translation).

* cited by examiner

METHOD AND DEVICE FOR DETECTING RESIDUAL IMAGE OF A DISPLAY PANEL

CROSS-REFERENCE TO RELATED APPLICATIONS

This application is a continuation of International Application No. PCT/CN2021/077888, filed on Feb. 25, 2021, which claims priority to Chinese Patent Application No. 202010276323.9 filed on Apr. 9, 2020, all of which are hereby incorporated by reference in their entireties.

TECHNICAL FIELD

The present application relates to the technical field of display, and in particular to a method and device for detecting residual image of a display panel.

BACKGROUND

A display panel needs to be tested for various indicators before delivery. Among various indicators, a disappearance time of residual image is an important indicator to evaluate a quality of the display panel. Residual image refers to a phenomenon that after the display panel has displayed an image for a time period, when the display panel switches to another image, the previous image remains and can disappear after a time period.

How to accurately and effectively detect a residual image level of the display panel and to objectively evaluate the quality of the display panel has become an urgent problem to be solved at present.

SUMMARY

The present application provides a method and device for detecting residual image of a display panel.

In one aspect, embodiments of the present application provides a method for detecting residual image of a display panel, including: controlling a display panel to be tested to display a checkerboard image, wherein the checkerboard image includes a plurality of pure-color sub-images arranged in a matrix, and gray scales of any two adjacent pure-color sub-images are a first gray scale and a second gray scale respectively; controlling, after the checkerboard image has been displayed for a first predetermined time period, the display panel to be tested to display a detection image with a predetermined gray scale, wherein the predetermined gray scale is between the first gray scale and the second gray scale; controlling a reference display panel to display a calibration image, wherein the calibration image includes a plurality of first matrix images and a plurality of second matrix images arranged in a matrix, each of the first matrix images and each of the second matrix images are arranged alternately, each of the first matrix images includes a plurality of first cells, the number of the first cells in each of the first matrix images is the same as the number of corresponding sub-pixels in each of the pure-color sub-images, a gray scale of each of the first matrix images is the same as the predetermined gray scale, each of the second matrix images includes a plurality of second cells, the number of the second cells in each of the second matrix images is the same as the number of corresponding sub-pixels in each of the pure-color sub-images, gray scales of each of the second matrix images includes a third gray scale and a fourth gray scale, the third gray scale is the same as the predetermined gray scale, and the fourth gray scale is different from the predetermined gray scale; comparing the detection image and the calibration image to obtain a residual image level of the display panel to be tested, wherein the residual image level has a corresponding relationship with a ratio of the number of the second cells with the third gray scale to the number of the second cells with the fourth gray scale.

In another aspect, embodiments of the present application further provides a device for detecting residual image of a display panel, including: a control module configured to control a display panel to be tested to switch a checkerboard image to a detection image with a predetermined gray scale after the display panel to be tested has displayed the checkerboard image for a first predetermined time period, wherein the checkerboard image includes a plurality of pure-color sub-images arranged in a matrix, gray scales of any two adjacent pure-color sub-images are a first gray scale and a second gray scale respectively, and the predetermined gray scale is between the first gray scale and the second gray scale; a reference display panel configured to display a calibration image, wherein the calibration image includes a plurality of first matrix images and a plurality of second matrix images arranged in a matrix, each of the first matrix images and each of the second matrix images are arranged alternately, each of the first matrix images includes a plurality of first cells, the number of the first cells in each of the first matrix images is the same as the number of corresponding sub-pixels in each of the pure-color sub-images, a gray scale of each of the first matrix images is the same as the predetermined gray scale, each of the second matrix images includes a plurality of second cells, the number of the second cells in each of the second matrix images is the same as the number of corresponding sub-pixels in each of the pure-color sub-images, gray scales of each of the second matrix images includes a third gray scale and a fourth gray scale, the third gray scale is the same as the predetermined gray scale, the fourth gray scale is different from the predetermined gray scale, a residual image level of the display panel to be tested has a corresponding relationship with a ratio of the number of the second cells with the third gray scale to the number of the second cells with the fourth gray scale, wherein the calibration image is used to be compared with the detection image to obtain the residual image level of the display panel to be tested.

The present application provides a method and device for detecting residual image of a display panel, wherein the method for detecting residual image of a display panel controls a display panel to be tested to display a detection image with a predetermined gray scale after the display panel to be tested has displayed a checkerboard image for a first predetermined time period, and controls a reference display panel to display a calibration image that can define a residual image level. Since the calibration image includes first matrix images and second matrix images, the calibration image can define the residual image level, by making each of the first matrix images include first cells whose number is same as the number of corresponding sub-pixels in each of pure-color sub-images and making a gray scale of each of the first matrix images the same as the predetermined gray scale so as to enable the first matrix images and the pure-color sub-images to have a same display environment and display effect, making each of the second matrix images include second cells whose number is same as the number of corresponding sub-pixels in each of the pure-color sub-images so as to enable the second matrix images and the pure-color sub-images to have a same display environment and display effect, and reasonably setting the number of second cells with a third gray scale and the number of second cells with a fourth gray scale based on a residual image level so as to enable a significant brightness difference between the first matrix images and the second matrix images to be formed, to more accurately perform calibration of residual image of the display panel. By comparing the detection image and the calibration image, for example, comparing a brightness difference of the detection image and a brightness difference of the calibration image, to accurately test the residual image level of a display panel to be tested, and reduce a uncertainty of different residual image testers in a residual image test of the display panel to be tested, the residual image level of the display panel can be objectively and accurately evaluated, so as to provide a reliable basis for a quality evaluation of the display panel.

BRIEF DESCRIPTION OF THE DRAWINGS

By reading the following detailed description of non-limiting embodiments with reference to the drawings, other features, purposes and advantages of the present application will become more apparent, wherein the same or similar reference numbers indicate the same or similar features, and the drawings are not drawn to an actual scale.

DETAILED DESCRIPTION

Figure 1:
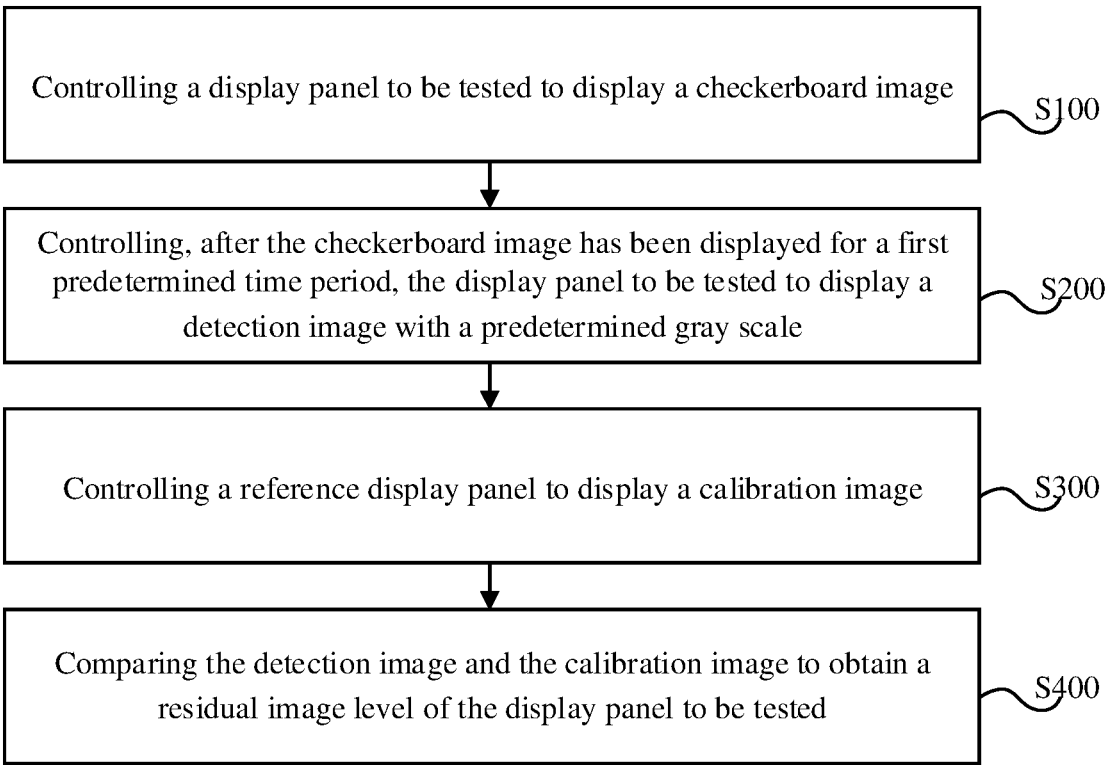
FIG. 1 is a schematic flowchart of a method for detecting residual image of a display panel according to an embodiment of the present application.

Features and exemplary embodiments of various aspects of the present application will be described in detail below. In the following detailed description, many specific details are set forth in order to provide a comprehensive understanding of the present application. The following description of embodiments is only to provide a better understanding of the present application by showing examples of the present application. In the drawings and the following description, at least part of well-known structures and technologies are not shown in order to avoid unnecessary limitations on the present application; and, for clarity, the size of some structures may be exaggerated. In addition, the features, structures or characteristics described below may be combined in one or more embodiments in any suitable manner.

In a research and development stage and a mass production stage of a display panel, certain bad samples will inevitably be produced. In order to ensure a quality of a display panel and control a production cost, performing a defect detection on the display panel, for example, detecting a residual image level of the display panel becomes an indispensable important part for the display panel.

Usually, a manual visual detection method is used to detect a residual image level of a display panel to be tested, that is, the residual image level is judged by visually inspecting a disappearance time of residual image. However, the manual visual detection method is susceptible to subjective influence of a tester, and the disappearance time of residual image of the display panel to be tested observed by different testers or observed by a same tester at different times may be different, and thus it is difficult to guarantee a stability of test of the residual image level of the display panel to be tested.

In order to solve the above-mentioned problems, embodiments of the present application provide a method for detecting residual image of a display panel and a device for detecting residual image of a display panel. Hereinafter, the method for detecting residual image of a display panel and the device for detecting residual image of a display panel according to embodiments of the present application will be described in detail with reference to FIGS. 1 to 8.

The display panel in the embodiments may be a liquid crystal display (LCD), an organic light-emitting diode (OLED) display panel or a Micro-LED display panel. There is no restriction on a type of the display panel in the present application.

Referring to FIG. 1, which shows a schematic flowchart of a method for detecting residual image of a display panel according to an embodiment of the present application. The method for detecting residual image of the display panel in this embodiment includes: S100. controlling a display panel to be tested to display a checkerboard image.

Figure 2:
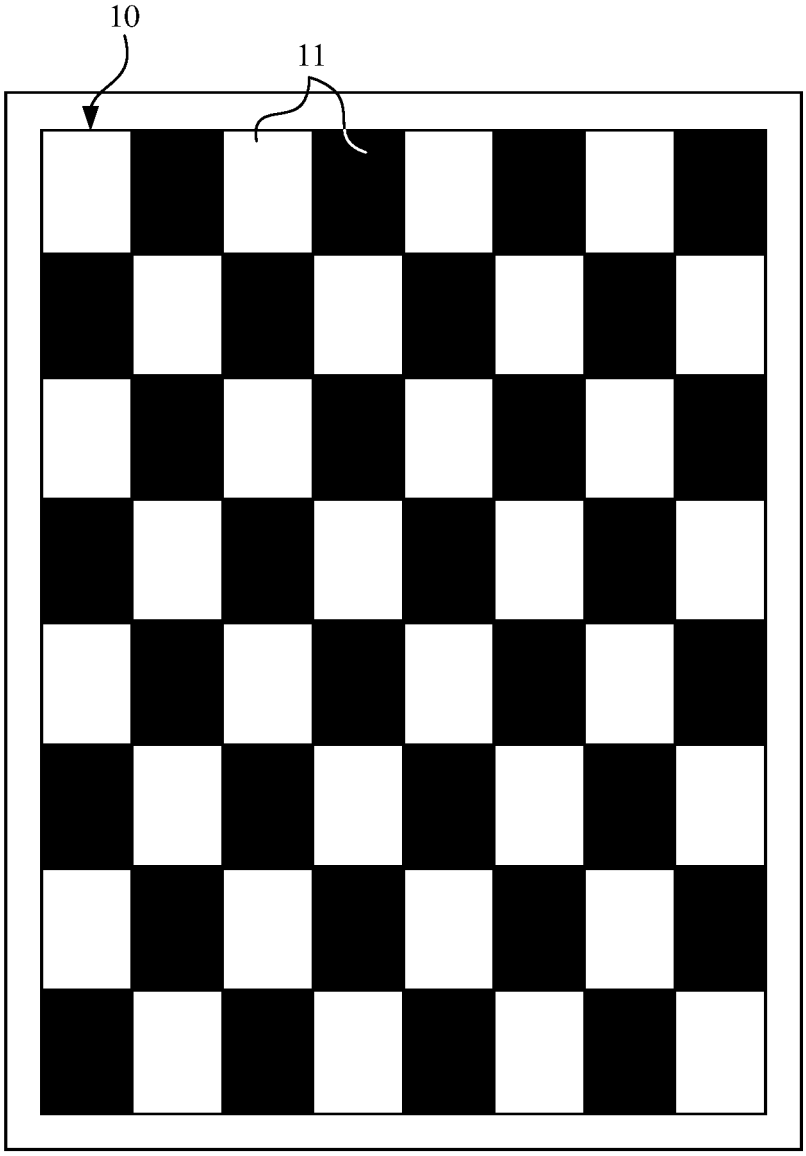
FIG. 2 is an exemplary schematic diagram of displaying a checkerboard image on a display panel to be tested.

Referring to FIG. 2, which shows an exemplary schematic diagram of displaying the checkerboard image on the display panel to be tested. In the embodiments of the present application, when detecting residual image of the display panel to be tested, the display panel to be tested displays a checkerboard image 10 first. The checkerboard image 10 includes a plurality of pure-color sub-images 11 arranged in a matrix, and gray scales of any adjacent two pure-color sub-images 11 are a first gray scale and a second gray scale respectively, wherein the first gray scale and the second gray scale are different. Because the first gray scale and the second gray scale are different, there is a brightness difference for any two adjacent pure-color sub-images 11. Optionally, the first gray scale and the second gray scale may be a maximum value and a minimum value of gray scales that can be displayed on the display panel to be tested, thereby improving an accuracy of detection of residual image of the display panel. One of the first gray scale and the second gray scale may be L0, and the other may be L255, that is, the display panel to be tested displays a black and white checkerboard image 10.

In specific implementation, the checkerboard image 10 displayed on the display panel to be tested may be adjusted according to a ratio of the display panel to be tested. Illustratively, the checkerboard image 10 may be a checkerboard arranged in an 8×8 matrix. Optionally, a shape of each pure-color sub-image 11 of the checkerboard image 10 is a rectangle. For the checkerboard image 10 arranged in an 8×8 matrix, the checkerboard may be divided according to a pixel arrangement structure of the display panel to be tested, for example, a number of rows of sub-pixels and a number of columns of sub-pixels of the display panel to be tested may be equally divided into 8 portions, to obtain a corresponding checkerboard. A specific structure and matrix arrangement of the checkerboard image 10 may be set according to user requirements.

As shown in FIG. 1, the method for detecting residual image of the display panel in this embodiment further includes: S200. controlling, after the checkerboard image has been displayed for a first predetermined time period, the display panel to be tested to display a detection image with a predetermined gray scale.

Figure 3:
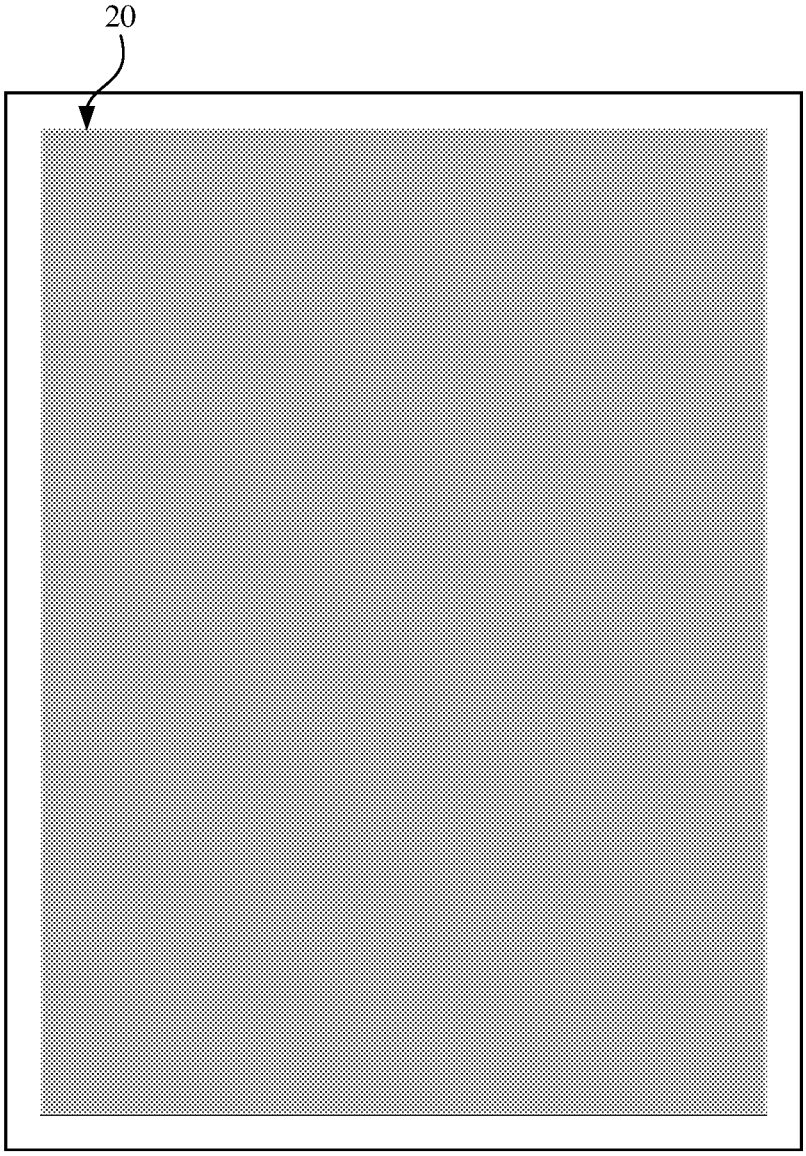
FIG. 3 is an exemplary schematic diagram of displaying a detection image on a display panel to be tested.

Referring to FIG. 3, which shows an exemplary schematic diagram of displaying the detection image on the display panel to be tested. The detection image 20 in this embodiment has a predetermined gray scale, and the predetermined gray scale is between the first gray scale and the second gray scale. When one of the first gray scale and the second gray scale is L0 and the other is L255, the detection image 20 is an image with a preset gray scale level between a black image and a white image, that is, a brightness of the detection image 20 is for an image between a brightest image (white image) and a darkest image (black image). Optionally, in detection of residual image of the display panel to be tested, the preset gray scale may be L127.

In specific implementation, the first predetermined time period of displaying the checkerboard image 10 may be set according to user requirements, and the first predetermined time period may be 10 minutes, one hour, two hours or longer. By setting a reasonable first predetermined time period, an accuracy of detection of a residual image level of the display panel can be improved.

As shown in FIG. 1, the method for detecting residual image of the display panel in this embodiment further includes: S300. controlling a reference display panel to display a calibration image.

Figure 4:
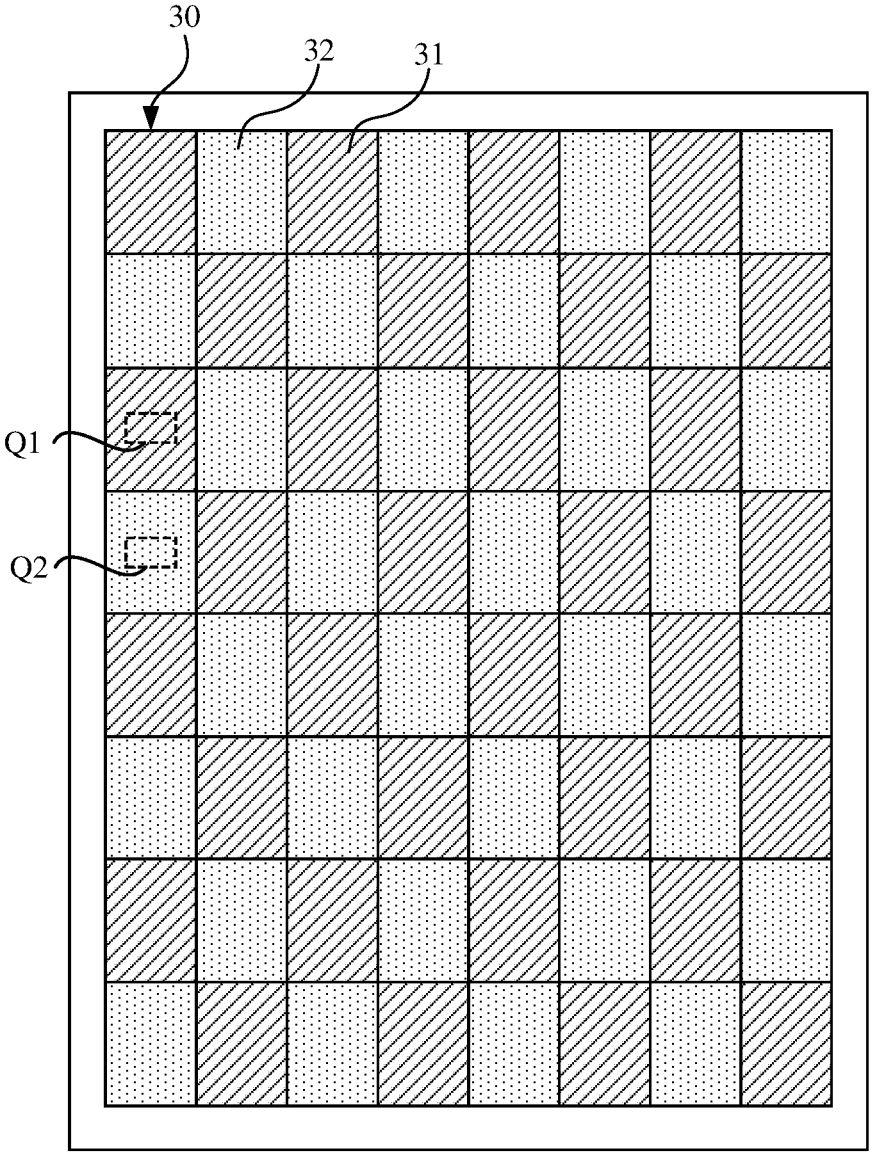
FIG. 4 is an exemplary schematic diagram of displaying a calibration image on a reference display panel.
Figure 5:
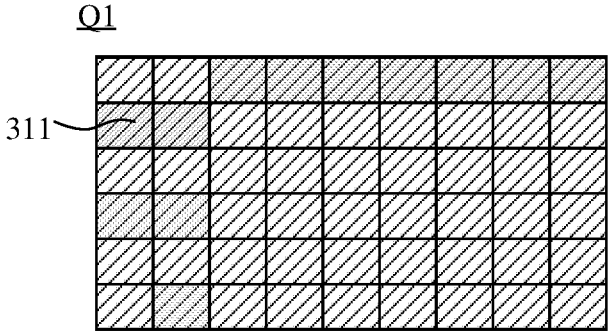
FIG. 5 is an enlarged view of Q1 in FIG. 4.
Figure 6:
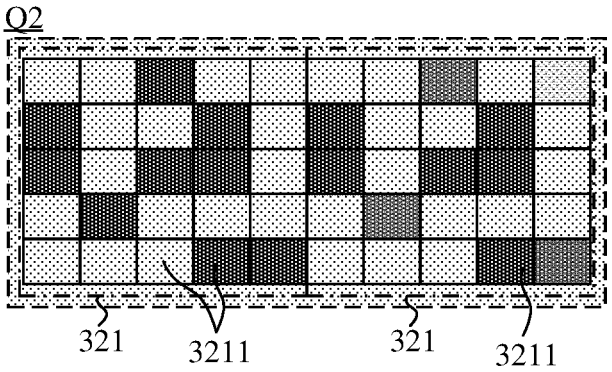
FIG. 6 is an enlarged view of Q2 in FIG. 4.

Referring to FIGS. 4-6 together, FIG. 4 shows an exemplary schematic diagram of displaying a calibration image on a reference display panel, FIG. 5 shows an enlarged view of Q1 in FIG. 4, and FIG. 6 is an enlarged view of Q2 in FIG. 4. In FIGS. 4-6, a same filling pattern is used to represent images with a same gray scale. The calibration image 30 in the embodiments of the present application includes a plurality of first matrix images 31 and a plurality of second matrix images 32 arranged in a matrix. Each of the first matrix images 31 and each of the second matrix images 32 are alternately arranged. Each of the first matrix images 31 includes a plurality of first cells 311, the number of the first cells 311 included in each of the first matrix images 31 is the same as the number of corresponding sub-pixels in each of the pure-color sub-images 11, and a gray scale of each of the first matrix images 31 is the same as the predetermined gray scale. By setting the number of first cells 311 in each of the first matrix images 31 to be the same as the number of corresponding sub-pixels in each of the pure-color sub-images 11, and setting the gray scale of each of the first matrix images 31 to be the same as the predetermined gray scale, each of the first matrix images 31 has a same display environment and a same display effect as each of the pure-color sub-images 11, which effectively avoids affecting a calibration function of the calibration image 30 when the display effect is inconsistent. A shape and size of each of the first cells 311 may be the same as a shape and size of each of the sub-pixels.

Referring to FIG. 6, each of the second matrix images 32 includes a plurality of second cells 3211. The number of the second cells 3211 in each of the second matrix images 32 is the same as the number of corresponding sub-pixels in each of the pure-color sub-images 11. A shape and size of each of the second cells 3211 is the same as a shape and size of each of corresponding sub-pixels in each of the pure-color sub-images 11. Gray scales of each of the second matrix images 32 include a third gray scale and a fourth gray scale, wherein the third gray scale is the same as the predetermined gray scale, the fourth gray scale is different from the predetermined gray scale, and a residual image level has a corresponding relationship with a ratio of the number of second cells 3211 with the third gray scale to the number of second cells 3211 with the fourth gray scale. By setting the number of second cells 3211 in each of the second matrix images 32 to be the same as the number of corresponding sub-pixels in each of the pure-color sub-images 11 so as to enable each of the second matrix images 32 to have a same display environment and a same display effect as each of the pure-color sub-images 11, and by reasonably setting the number of second cells 3211 with the third gray scale and the number of second cells 3211 with the fourth gray scale based on the residual image level so as to enable a significant brightness difference between the first matrix images 31 and the second matrix images 32 to be formed, calibration of the residual image level of the display panel to be tested is performed more accurately. Optionally, an image displayed in each of the second cells 3211 is a pure-color image.

Optionally, a difference between the third gray scale and the fourth gray scale is one gray scale. Under a condition that the preset gray scale may be L127, the third gray scale is L127, and the fourth gray scale is L126 or L128. Optionally, the difference between the third gray scale and the fourth gray scale may be set according to user requirements, and the difference between the third gray scale and the fourth gray scale may also be two gray scales or even more.

As shown in FIG. 1, the method for detecting residual image of the display panel in this embodiment further includes: S400. comparing the detection image and the calibration image to obtain a residual image level of the display panel to be tested.

In detecting residual image of the display panel to be tested, when the display panel to be tested displays the detection image 20, under a condition that residual image of the display panel has not completely disappeared, a tester will still see that there is a brightness difference on the detection image 20 when observing the detection image 20. At this time, the tester may compare the detection image 20 and the calibration image 30, for example, may visually compare a brightness difference of the detection image 20 and a brightness difference of the calibration image 30 within a predetermined time period, to obtain the residual image level of the display panel to be tested. Of course, the brightness difference of the detection image 20 and the brightness difference of the calibration image 30 may also be collected by a brightness collection device, and the detection image 20 and the calibration image 30 may be compared to obtain the residual image level of the display panel to be tested.

The present application provides a method for detecting residual image of a display panel, wherein the method for detecting residual image of a display panel controls a display panel to be tested to display the detection image 20 with a predetermined gray scale after the display panel to be tested has displayed the checkerboard image 10 for a first predetermined time period, and controls the reference display panel 120 to display the calibration image 30 that can define a residual image level. By comparing the detection image 20 and the calibration image 30, for example, the tester can accurately determine whether the brightness difference of the detection image 20 is consistent with the brightness difference of the calibration image 30, to accurately detect the residual image level of the display panel, and reduce a uncertainty of different residual image testers in a residual image test of the display panel to be tested, so that the residual image level of the display panel to be tested can be objectively and accurately evaluated, so as to provide a reliable basis for a quality evaluation of the display panel.

Figure 7:
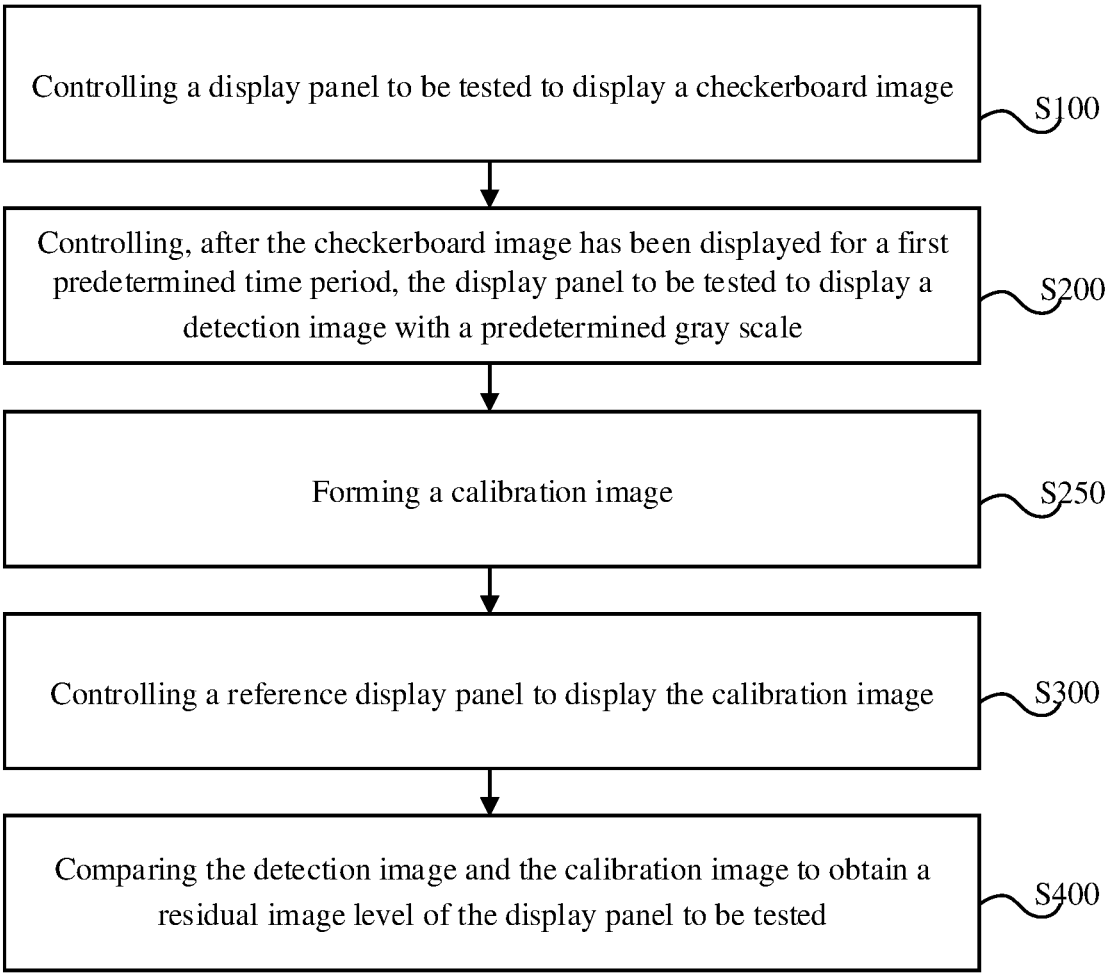
FIG. 7 is a schematic flowchart of a method for detecting residual image of a display panel according to another embodiment of the present application.

Referring to FIG. 7, which shows a schematic flowchart of a method for detecting residual image of a display panel according to another embodiment of the present application. In some embodiments, before step S300 of controlling the reference display panel 120 to display the calibration image 30, the method for detecting residual image of the display panel further includes: S250 of forming the calibration image.

Step S250 of forming the calibration image includes: forming the first matrix images 31 based on the number of corresponding sub-pixels in each of the pure-color sub-images 11 in the display panel to be tested and the predetermined gray scale; forming the second matrix images 32 based on the number of corresponding sub-pixels in each of the pure-color sub-images 11 in the display panel to be tested, the predetermined gray scale, and the residual image level; and arranging the first matrix images 31 and the second matrix images 32 alternately and in a matrix to form the calibration image 30.

Optionally, MATLAB software may be used to make the calibration image 30, wherein a shape and size of each of the first matrix images 31 are the same as a shape and size of each of the pure-color sub-images 11 in the display panel to be tested, so that a display environment of each of the first matrix images 31 is consistent with a display environment of one of the pure-color sub-images 11, thereby reducing a visual impact on a tester due to different shapes and sizes of each of the first matrix images 31 and each of the pure-color sub-images 11, and improving an accuracy of visually detecting the residual image level of the display panel to be tested by the tester. Similarly, a shape and size of each of the second matrix images 32 are the same as a shape and size of each of the pure-color sub-images 11 in the display panel to be tested, so that a display environment and display effect of each of the second matrix images 32 are consistent with a display environment and display effect of one of the pure-color sub-images 11. By arranging the first matrix images 31 and the second matrix images 32 alternately and in a matrix to form the calibration image 30, a brightness change of a display image during disappearance of residual image of the display panel to be tested can be reflected more accurately, to make the residual image level of the calibration image 30 fixed, and to compare the detection image 20 whose brightness has changed with the calibration image 30 whose brightness remains fixed, so as to reduce an uncertainty caused by subjective judgment of the tester, thereby effectively reducing a difference in detecting residual image of the display panel to be tested by a same tester at different times or by different testers.

Further, by forming the calibration image 30, the calibration image 30 can be saved, copied or pasted in a form of an image file, so as to enable calibration of residual image levels of display panels to be tested at different test locations, which improves a versatility of the method for detecting residual image of a display panel according to the embodiments of the present application.

In order to improve an efficiency of making the calibration image 30 and simplify a difficulty of making the calibration image 30, in some embodiments, each of the second matrix images 32 includes a plurality of matrix sub-images 321, and each of the matrix sub-images 321 includes a plurality of second cells 3211 arranged in a matrix. The step of forming the second matrix images 32 based on the number of corresponding sub-pixels in each of the pure-color sub-images 11 in the display panel to be tested, the predetermined gray scale, and the residual image level includes: forming the matrix sub-images 321 based on the number of corresponding sub-pixels in each of the pure-color sub-images 11 in the display panel to be tested, the predetermined gray scale, and the residual image level, wherein the residual image level has the corresponding relationship with a ratio of the number of the second cells 3211 in each of the matrix sub-images 321 with the third gray scale to the number of the second cells 3211 in each of the matrix sub-images 321 with the fourth gray scale; and arranging the plurality of matrix sub-images 321 in a matrix to form each of the second matrix images 32.

In specific implementation, one of the matrix sub-images 321 may be formed using MATLAB software. The one of the matrix sub-images 321 can define a residual image level, and then MATLAB software can be used to copy the one of the matrix sub-images 321 and arrange the copied matrix sub-images 321 in a matrix to form each of the second matrix images 32, which effectively improves a production efficiency of the second matrix images 32.

In some embodiments, multiple calibration images 30 may be formed to perform more accurate detection of the residual image level of the display panel to be tested, and residual image levels defined by the multiple calibration images 30 are different. Under a condition that the residual image level increases, the number of the second cells 3211 in each of the matrix sub-images 321 with the fourth gray scale increases in an arithmetic sequence. Optionally, a tolerance of the arithmetic sequence may be set to be greater than or equal to 2. By reasonably setting a relationship between the number of the second cells 3211 with the fourth gray scale and the number of the second cells 3211 with the third gray scale, a brightness difference in the calibration image 30 can be more obvious, so as to define the residual image level more accurately. It should be noted that when the residual image level increases, it indicates that a disappearance time of residual image of the display panel to be tested increases, that is, it indicates that an ability of disappearance of residual image of the display panel to be tested is worse.

A specific process of forming the matrix sub-images 321 will be described below. Specifically, each of the second matrix images 32 may be divided equally according to a number of rows of the second cell 3211 and the number of columns of the second cell 3211, to define a size of each of the matrix sub-images 321.

In some embodiments, each of the matrix sub-images 321 includes an even number of second cells 3211 arranged in a matrix, the residual image level includes a first level, and in the first level, the number of the second cells 3211 in each of the matrix sub-images 321 with the fourth gray scale is the same as the number of the second cells 3211 in each of the matrix sub-images 321 with the third gray scale. For example, under a condition that each of the matrix sub-images 321 includes the second cells 3211 arranged in a 6×6 matrix, both the number of the second cells 3211 in each of the matrix sub-images 321 with the fourth gray scale and the number of the second cells 3211 in each of the matrix sub-images 321 with the third gray scale are 18. The second cells 3211 with the fourth gray scale and the second cells 3211 with the third gray scale may be arranged alternately, or may be arranged randomly.

The residual image level may also include a second level and a third level. Taking, as an example for illustration, that each of the matrix sub-images 321 includes the second cells 3211 arranged in a 6×6 matrix, in the second level, the number of the second cells 3211 in each of the matrix sub-images 321 with the fourth gray scale is 18+N, where N is a positive integer and N is greater than or equal to 2, and the number of the second cells 3211 in each of the matrix sub-images 321 with the third gray scale is 18-N. In the third level, the number of the second cells 3211 in each of the matrix sub-images 321 with the fourth gray scale is 18+2N, and the number of the second cells 3211 in each of the matrix sub-images 321 with the third gray scale is 18-2N. With the above settings, a calibration image 30 with a residual image level being the second level and a calibration image 30 with a residual image level being the third level may be formed, so that the residual image level of the display panel to be tested can be calibrated more accurately, and at the same time, by reasonably setting a difference for the number of second cells 3211 in each of the matrix sub-images 321 with the fourth gray scale in different residual image levels, the calibration images 30 defining different residual image levels have obvious visual effect differences.

In some embodiments, each of the matrix sub-images 321 includes an odd number of second cells 3211, the residual image level includes a first level, and in the first level, a difference between the number of the second cells 3211 in each of the matrix sub-images 321 with the fourth gray scale and the number of the second cells 3211 in each of the matrix sub-images 321 with the third gray scale is 1. For example, under a condition that each of the matrix sub-images 321 includes the second cells 3211 arranged in a 5×5 matrix, in the first level, one of the number of the second cells 3211 in each of the matrix sub-images 321 with the fourth gray scale and the number of the second cells 3211 in each of the matrix sub-images 321 with the third gray scale is 13, and the other is 12. The second cells 3211 with the fourth gray scale and the second cells 3211 with the third gray scale may be arranged alternately, or may be arranged randomly. Under a condition that the residual image level also includes a second level, in the second level, the number of the second cells 3211 in each of the matrix sub-images 321 with the fourth gray scale may be 13+D, where D is a positive integer and D is greater than or equal to 2, and the number of the second cells 3211 in each of the matrix sub-images 321 with the third gray scale is 12-D.

In order to calibrate different residual image levels of display panels to be tested, the calibration image 30 includes a first calibration image and a second calibration image. A residual image level defined by the first calibration image is different from a residual image level defined by the second calibration image. The method for detecting residual image of a display panel also includes: controlling the reference display panel 120 to simultaneously display the first calibration image and the second calibration image; and comparing the detection image 20, the first calibration image, and the second calibration image to obtain the residual image level of the display panel to be tested.

A method of forming the first calibration image and a method of forming the second calibration image are similar, and both the first calibration image and the second calibration image may be formed by splicing the first matrix images 31 and the second matrix images 32. With the above settings, a tester compares different calibration images 30 with the detection images 20 of the display panel to be tested, so as to improve an accuracy of detecting the residual image level of the display panel to be tested.

In some embodiments, step S400 of comparing the detection image and the calibration image to obtain a residual image level of the display panel to be tested includes: after the display panel to be tested has displayed the detection image 20 for a second predetermined time period, comparing a brightness difference of the detection image 20 and a brightness difference of the calibration image 30 to obtain the residual image level of the display panel to be tested.

Specifically, after the display panel to be tested has displayed the detection image 20 for the second predetermined time period, the tester can visually detect a brightness difference of the detection image 20 and a brightness difference of the calibration image 30 respectively, and compare the visually detected brightness difference of the detection image 20 and the brightness difference of the calibration image 30, to obtain the residual image level of the display panel to be tested. For example, after the second predetermined time period, if the tester obtains that the brightness difference of the detection image 20 is the same as the brightness difference of the calibration image 30, then the tester obtains that the residual image level of the display panel to be tested at the second predetermined time period is the same as that of the calibration image 30. After the second predetermined time period, if the tester obtains that the brightness difference of the detection image 20 is lower than the brightness difference of the calibration image 30, then the tester obtains that the residual image level of the display panel to be tested at the second predetermined time period is better than the residual image level defined by the calibration image 30. Under a condition that the reference display panel simultaneously displays the first calibration image and the second calibration image, the tester compares the visually detected brightness difference of the detection image 20 with a brightness difference of the first calibration image and a brightness difference of the second calibration image respectively, so as to obtain the residual image level of the display panel to be tested.

In some embodiments, step S400 of comparing the detection image and the calibration image to obtain a residual image level of the display panel to be tested includes: comparing a brightness difference of the detection image 20 and a brightness difference of the calibration image 30 continuously, to obtain a changing time period when the brightness difference of the detection image 20 changes to be the same as the brightness difference of the calibration image 30, and to obtain the residual image level of the display panel to be tested based on the changing time period.

Specifically, after the display panel to be tested has displayed the detection image 20 for the second predetermined time period, the tester starts timing, and then may compare the brightness difference of the detection image 20 with the brightness difference of the calibration image 30 continuously. The timing ends when it is observed the brightness difference of the detection image 20 changes to be the same as the brightness difference of the calibration image 30, a changing time period is obtained, and then the tester obtains the residual image level of the display panel to be tested based on the changing time period. Optionally, a preset changing time period of the display panel to be tested that meets requirements may be preset, and under a condition that the changing time period of the display panel to be tested is less than or equal to the preset changing time period, it indicates that the display panel to be tested is a qualified display panel, thereby improving a final quality of the display panel.

In order to verify the method for detecting residual image of a display panel according to the embodiments of the present application, the detection method according to the embodiments of the present application is compared with a method for detecting residual image of a display panel to be tested provided by a comparative example.

The method for detecting residual image in the comparative example includes: controlling a display panel to be tested to display a black and white checkerboard image; controlling, after the black and white checkerboard image has been displayed for a third predetermined time period, the display panel to be tested to display a detection image with a predetermined gray scale; and determining a time of disappearance of residual image, to obtain a residual image level of the display panel to be tested.

The first predetermined time period of displaying the checkerboard image in the detection method according to the embodiments of the present application is the same as the third predetermined time period in the comparative example, and the predetermined gray scales in the two methods are the same, for example, may be L127.

During the test, a number of residual image testers used the detection method provided by the comparative example and the detection method provided by the embodiments of the present application respectively, to test four same display panels to be tested, and the test was repeated 3 to 4 times.

By comparing the test results, it is obtained that under a condition that the testers use the method for detecting residual image of a display panel provided by the embodiments of the present application for testing, when each tester performs residual image test on 4 display panels to be tested, an uncertainty is reduced by an average of 20 s, and the obtained residual image level of the display panel to be tested is more accurate and reliable. When the same display panel to be tested is tested three times, a time difference for determining the residual image level of the display panel to be tested is about 10 s, which indicates that the detection method according to the embodiments of the present application has better repeatability and is convenient for multiple measurements.

In summary, the present application provides a method for detecting residual image of a display panel and a device 100 for detecting residual image of a display panel, wherein the method for detecting residual image of a display panel controls a display panel to be tested to display a detection image 20 with a predetermined gray scale after the display panel to be tested has displayed a checkerboard image 10 for a first predetermined time period, and controls a reference display panel 120 to display a calibration image 30 that can define a residual image level. Since the calibration image 30 includes first matrix images 31 and second matrix images 32, calibration of residual image of the display panel is more accurately performed by making each of the first matrix images 31 include first cells 311 whose number is same as a number of corresponding sub-pixels in each of pure-color sub-images 11 and making a gray scale of each of the first matrix images 31 the same as the predetermined gray scale so as to enable the first matrix images 31 and the pure-color sub-images 11 to have a same display environment and display effect, making each of the second matrix images 32 include second cells 3211 whose number is same as a number of corresponding sub-pixels in each of the pure-color sub-images 11 so as to enable the second matrix images 32 and the pure-color sub-images 11 to have a same display environment and display effect, and reasonably setting a number of second cells 3211 with a third gray scale and a number of second cells 3211 with a fourth gray scale based on a residual image level so as to enable a significant brightness difference between the first matrix images 31 and the second matrix images 32 to be formed. By comparing the detection image 20 and the calibration image 30, for example, comparing a brightness difference of the detection image 20 and a brightness difference of the calibration image 30, to accurately test the residual image level of a display panel to be tested, a uncertainty of different residual image testers in a residual image test of the display panel to be tested can be reduced, the residual image level of the display panel to be tested can be objectively and accurately evaluated, so as to provide a reliable basis for a quality evaluation of the display panel.

Figure 8:
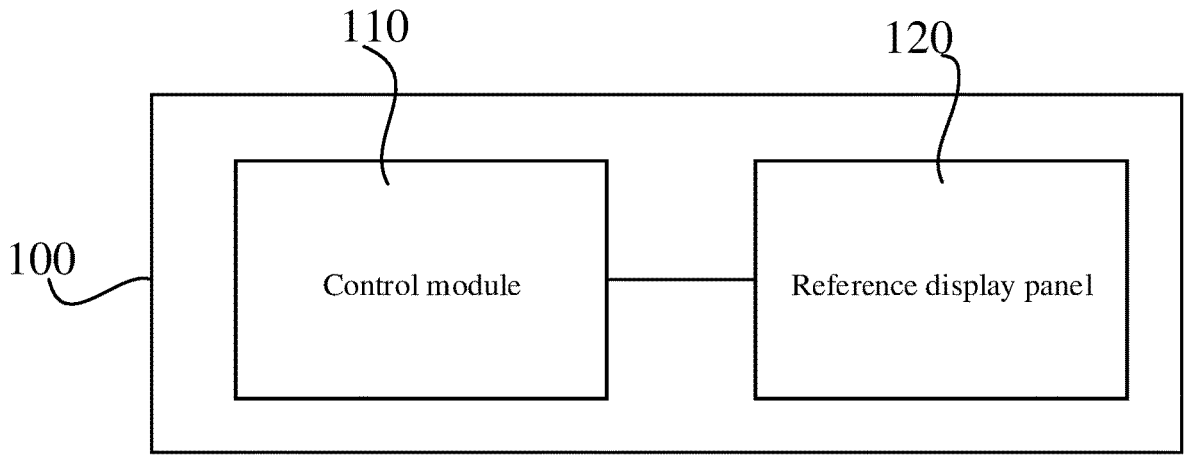
FIG. 8 is a device for detecting residual image of a display panel according to an embodiment of the present application.

Referring to FIG. 8, which shows a device for detecting residual image of a display panel according to an embodiment of the present application. As shown in FIG. 8, the embodiments of the present application also provides a device 100 for detecting residual image of a display panel, which includes a control module 110 and a reference display panel 120.

The control module 110 is configured to control a display panel to be tested to switch the checkerboard image 10 to the detection image 20 with a predetermined gray scale after the display panel to be tested has displayed the checkerboard image 10 for a first predetermined time period, wherein the checkerboard image 10 includes a plurality of pure-color sub-images 11 arranged in a matrix, gray scales of any two adjacent pure-color sub-images 11 are a first gray scale and a second gray scale respectively, and the predetermined gray scale is between the first gray scale and the second gray scale.

Optionally, the control module 110 is also configured to control the reference display panel 120 to display the calibration image 30.

The reference display panel 120 is configured to display the calibration image 30, wherein the calibration image 30 can define a residual image level, the calibration image 30 includes a plurality of first matrix images 31 and a plurality of second matrix images 32 arranged in a matrix, each of the first matrix images 31 and each of the second matrix images 32 are arranged alternately, each of the first matrix images 31 includes a plurality of first cells 311, a number of the first cells 311 in each of the first matrix images 31 is the same as a number of corresponding sub-pixels in each of the pure-color sub-images 11, a gray scale of each of the first matrix images 31 is the same as the predetermined gray scale, each of the second matrix images 32 includes a plurality of second cells 3211, a number of the second cells 3211 in each of the second matrix images 32 is the same as a number of corresponding sub-pixels in each of the pure-color sub-images 11, gray scales of each of the second matrix images 32 includes a third gray scale and a fourth gray scale, the third gray scale is the same as the predetermined gray scale, the fourth gray scale is different from the predetermined gray scale, the residual image level of the display panel to be tested has a corresponding relationship with a ratio of a number of the second cells 3211 with the third gray scale to a number of the second cells 3211 with the fourth gray scale, wherein the calibration image 30 is used to be compared with the detection image 20 to obtain the residual image level of the display panel to be tested.

When detecting residual image of the display panel to be tested, the tester can visually compare the detection image 20 with the calibration image 30 to obtain the residual image level of the display panel to be tested.

In some embodiments, the device 100 for detecting residual image of a display panel may further include a brightness collection module and a processing module. The brightness collection module is configured to collect a brightness difference of the detection image 20 and a brightness difference of the calibration image 30, and the processing module is configured to compare the collected brightness difference of the detection image 20 and the collected brightness difference of the calibration image 30 to obtain the residual image level of the display panel to be tested. In specific implementation, a brightness collection module may be set directly above each of the pure-color sub-images 11 of the checkerboard image 10. When the checkerboard image 10 switches to the detection image 20, the brightness collection module may collect a brightness at multiple positions of the detection image 20 and transmit the collected brightness to the processing module, the processing module calculates a difference between the brightness collected by adjacent brightness collection modules respectively and performs averaging processing on multiple brightness differences to obtain the brightness difference of the detection image 20. Further, the brightness difference of the calibration image 30 may be measured in the same way. Therefore, with the device 100 for detecting residual image of a display panel according to the embodiments of the present application, by displaying the calibration image 30 which can fix the residual image level, and comparing the calibration image 30 and the detection image 20 during a process of detecting residual image, an accuracy of detecting residual image can be improved, a difference caused by different testers or by a same tester at different test times can be reduced, so as to provide a reliable basis for a quality evaluation of the display panel.

In some embodiments, the control module 110 and the processing module may include one or more processors, such as, but not limited to, a general-purpose processor, a dedicated processor, a special application processor, or a field programmable logic circuit. The processors may execute predetermined instructions to complete the above-mentioned control and processing functions. It can also be understood that the control module 110 and the processing module may also be implemented by dedicated hardware that performs specified functions or actions, or may be implemented by a combination of dedicated hardware and machine executable instructions. According to the above embodiments of the present application, these embodiments do not describe all the details in detail, nor do they limit the present application to only the specific embodiments described. Obviously, according to the above description, many modifications and changes can be made. This specification selects and specifically describes these embodiments in order to better explain the principles and practical applications of the present application, so that those skilled in the art can make good use of the present application and make modifications on the basis of the present application. The present application is only limited by the claims and their full scope and equivalents.

What is claimed is:

1. A method for detecting residual image of a display panel, comprising:

controlling a display panel to be tested to display a checkerboard image, wherein the checkerboard image comprises a plurality of pure-color sub-images arranged in a matrix, and gray scales of any two adjacent pure-color sub-images comprise a first gray scale and a second gray scale respectively;

controlling, after the checkerboard image has been displayed for a first predetermined time period, the display panel to be tested to display a detection image with a predetermined gray scale, wherein the predetermined gray scale is between the first gray scale and the second gray scale;

controlling a reference display panel to display a calibration image, wherein the calibration image comprises a plurality of first matrix images and a plurality of second matrix images arranged in a matrix, the first matrix images and the second matrix images are arranged alternately, each of the first matrix images comprises a plurality of first cells, the number of the first cells in each of the first matrix images is the same as the number of corresponding sub-pixels in each of the pure-color sub-images, a gray scale of each of the first matrix images is the same as the predetermined gray scale, each of the second matrix images comprises a plurality of second cells, the number of the second cells in each of the second matrix images is the same as the number of corresponding sub-pixels in each of the pure-color sub-images, gray scales of each of the second matrix images comprises the predetermined gray scale and a fourth gray scale, and the fourth gray scale is different from the predetermined gray scale;

comparing the detection image and the calibration image to obtain a residual image level of the display panel to be tested, wherein the residual image level has a corresponding relationship with a ratio of the number of the second cells with the predetermined gray scale to the number of the second cells with the fourth gray scale.

2. The method of claim 1, wherein before the controlling a reference display panel to display a calibration image, the method further comprises:

forming the calibration image, comprising:

forming the first matrix images based on the number of corresponding sub-pixels in each of the pure-color sub-images in the display panel to be tested and the predetermined gray scale;

forming the second matrix images based on the number of corresponding sub-pixels in each of the pure-color sub-images in the display panel to be tested, the predetermined gray scale, and the residual image level;

arranging the first matrix images and the second matrix images alternately and in a matrix to form the calibration image.

3. The method of claim 2, wherein each of the second matrix images comprises a plurality of matrix sub-images, and each of the matrix sub-images comprises a plurality of the second cells arranged in a matrix, and the forming the second matrix images based on the number of corresponding sub-pixels in each of the pure-color sub-images in the display panel to be tested, the predetermined gray scale, and the residual image level comprises:

forming the matrix sub-images based on the number of corresponding sub-pixels in each of the pure-color sub-images in the display panel to be tested, the predetermined gray scale, and the residual image level, wherein the residual image level has the corresponding relationship with a ratio of the number of the second cells in each of the matrix sub-images with the predetermined gray scale to the number of the second cells in each of the matrix sub-images with the fourth gray scale;

arranging the plurality of matrix sub-images in a matrix to form each of the second matrix images.

4. The method of claim 3, wherein under a condition that the residual image level increases, the number of the second cells in each of the matrix sub-images with the fourth gray scale increases in an arithmetic sequence.

5. The method of claim 4, wherein the number of the second cells in each of the matrix sub-images with the fourth gray scale increases in an arithmetic sequence with a tolerance greater than or equal to 2.

6. The method of claim 4, wherein:

each of the matrix sub-images comprises an even number of the second cells, the residual image level comprises a first level, and in the first level, the number of the second cells in each of the matrix sub-images with the fourth gray scale is the same as the number of the second cells in each of the matrix sub-images with the predetermined gray scale, or each of the matrix sub-images comprises an odd number of the second cells, the residual image level comprises a first level, and in the first level, a difference between the number of the second cells in each of the matrix sub-images with the fourth gray scale and the number of the second cells in each of the matrix sub-images with the predetermined gray scale is 1.

7. The method of claim 1, wherein a difference between the predetermined gray scale and the fourth gray scale is one gray scale, one of the first gray scale and the second gray scale is L0, the other is L255, and the predetermined gray scale is L127.

8. The method of claim 1, wherein the calibration image comprises a first calibration image and a second calibration image, and a residual image level defined by the first calibration image is different from a residual image level defined by the second calibration image, the method further comprises:

controlling the reference display panel to simultaneously display the first calibration image and the second calibration image;

comparing the detection image, the first calibration image and the second calibration image to obtain the residual image level of the display panel to be tested.

9. The method of claim 1, wherein the comparing the detection image and the calibration image to obtain a residual image level of the display panel to be tested comprises:

after the display panel to be tested has displayed the detection image for a second predetermined time period, comparing a brightness difference of the detection image and a brightness difference of the calibration image to obtain the residual image level of the display panel to be tested.

10. The method of claim 1, wherein the comparing the detection image and the calibration image to obtain a residual image level of the display panel to be tested comprises:

comparing a brightness difference of the detection image and a brightness difference of the calibration image continuously, to obtain a changing time period when the brightness difference of the detection image changes to be the same as the brightness difference of the calibration image, and to obtain the residual image level of the display panel to be tested based on the changing time period.

11. A device for detecting residual image of a display panel, comprising:

a control module configured to control a display panel to be tested to switch a checkerboard image to a detection image with a predetermined gray scale after the display panel to be tested has displayed the checkerboard image for a first predetermined time period, wherein the checkerboard image comprises a plurality of pure-color sub-images arranged in a matrix, gray scales of any two adjacent pure-color sub-images are a first gray scale and a second gray scale respectively, and the predetermined gray scale is between the first gray scale and the second gray scale;

a reference display panel configured to display a calibration image, wherein the calibration image comprises a plurality of first matrix images and a plurality of second matrix images arranged in a matrix, each of the first matrix images and each of the second matrix images are arranged alternately, each of the first matrix images comprises a plurality of first cells, the number of the first cells in each of the first matrix images is the same as the number of corresponding sub-pixels in each of the pure-color sub-images, a gray scale of each of the first matrix images is the same as the predetermined gray scale, each of the second matrix images comprises a plurality of second cells, the number of the second cells in each of the second matrix images is the same as the number of corresponding sub-pixels in each of the pure-color sub-images, gray scales of each of the second matrix images comprises the predetermined gray scale and a fourth gray scale, the fourth gray scale is different from the predetermined gray scale, a residual image level of the display panel to be tested has a corresponding relationship with a ratio of the number of the second cells with the predetermined gray scale to the number of the second cells with the fourth gray scale, wherein the calibration image is used to be compared with the detection image to obtain the residual image level of the display panel to be tested.

12. The device of claim 11, further comprising:

a brightness collection module configured to collect a brightness difference of the detection image and a brightness difference of the calibration image; and a processing module configured to compare the collected brightness difference of the detection image and the collected brightness difference of the calibration image to obtain the residual image level of the display panel to be tested.

* * * * *